US011685620B2

(12) United States Patent
Williamson et al.

(10) Patent No.: US 11,685,620 B2
(45) Date of Patent: Jun. 27, 2023

(54) MOVABLE GUIDES FOR MEDIA TRAYS

(71) Applicant: Hewlett-Packard Development Company, L.P., Spring, TX (US)

(72) Inventors: Alan Williamson, Boise, ID (US); Clinton Troy Jensen, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 137 days.

(21) Appl. No.: 17/256,466

(22) PCT Filed: Dec. 20, 2018

(86) PCT No.: PCT/US2018/066906
§ 371 (c)(1),
(2) Date: Dec. 28, 2020

(87) PCT Pub. No.: WO2020/131081
PCT Pub. Date: Jun. 25, 2020

(65) Prior Publication Data

US 2021/0300696 A1 Sep. 30, 2021

(51) Int. Cl.
*B65H 31/20* (2006.01)
*B65H 1/26* (2006.01)

(52) U.S. Cl.
CPC ..... *B65H 1/266* (2013.01); *B65H 31/20* (2013.01)

(58) Field of Classification Search
CPC ..... B65H 31/20; B65H 2511/10; B65H 2402/60; B65H 2405/114
See application file for complete search history.

(56) References Cited

U.S. PATENT DOCUMENTS

| | | | | |
|---|---|---|---|---|
| 5,333,852 | A | 8/1994 | Milillo et al. | |
| 5,923,942 | A | 7/1999 | Nuggehalli et al. | |
| 5,944,308 | A | 8/1999 | McLeod et al. | |
| 6,267,522 | B1 | 7/2001 | Slippy et al. | |
| 6,536,968 | B2 | 3/2003 | Lee et al. | |
| 6,619,656 | B2 | 9/2003 | Guddanti et al. | |
| 7,607,657 | B2 * | 10/2009 | Kawarago | B65H 1/266 271/171 |
| 7,731,181 | B2 | 6/2010 | Chang | |
| 2005/0269764 | A1 | 12/2005 | Lee et al. | |

(Continued)

FOREIGN PATENT DOCUMENTS

| | | | |
|---|---|---|---|
| DE | 10000591 | A1 | 4/2007 |
| JP | 10329951 | A | 12/1998 |

*Primary Examiner* — Howard J Sanders
(74) *Attorney, Agent, or Firm* — Brooks, Cameron & Huebsch, PLLC

(57) ABSTRACT

According to examples, an apparatus may include a guide frame, a standard position pawl movably attached to the guide frame, the standard position pawl to engage a standard pawl detent. The apparatus may also include a custom position pawl movably engaged with the guide frame, the custom position pawl to engage custom pawl teeth of a rack. The apparatus may further include a switch in movable engagement with the guide frame, the switch being movable between a first position at which the custom position pawl is maintained at a disengaged position with respect to the custom pawl teeth of the rack and a second position at which the custom position pawl is free to move between the disengaged position and an engaged position with respect to the custom pawl teeth of the rack.

14 Claims, 5 Drawing Sheets

(56) References Cited

U.S. PATENT DOCUMENTS

| | | | | |
|---|---|---|---|---|
| 2006/0244203 | A1 | 11/2006 | Kirby et al. | |
| 2015/0298921 | A1* | 10/2015 | Ishikura | B65H 1/04 271/171 |
| 2017/0121138 | A1* | 5/2017 | Koga | G03G 15/6502 |

* cited by examiner

MOVABLE GUIDES FOR MEDIA TRAYS

BACKGROUND

Printers, copy machines, facsimile machines and multiple function peripheral (MFP) devices may include a media tray that may accommodate variously sized media. The media trays may include some form of guide that may generally be used to help correctly align the media in the media trays. In addition, a series of notches or holes may be provided in the media trays into which the guides may engage to accommodate a plurality of media sizes.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
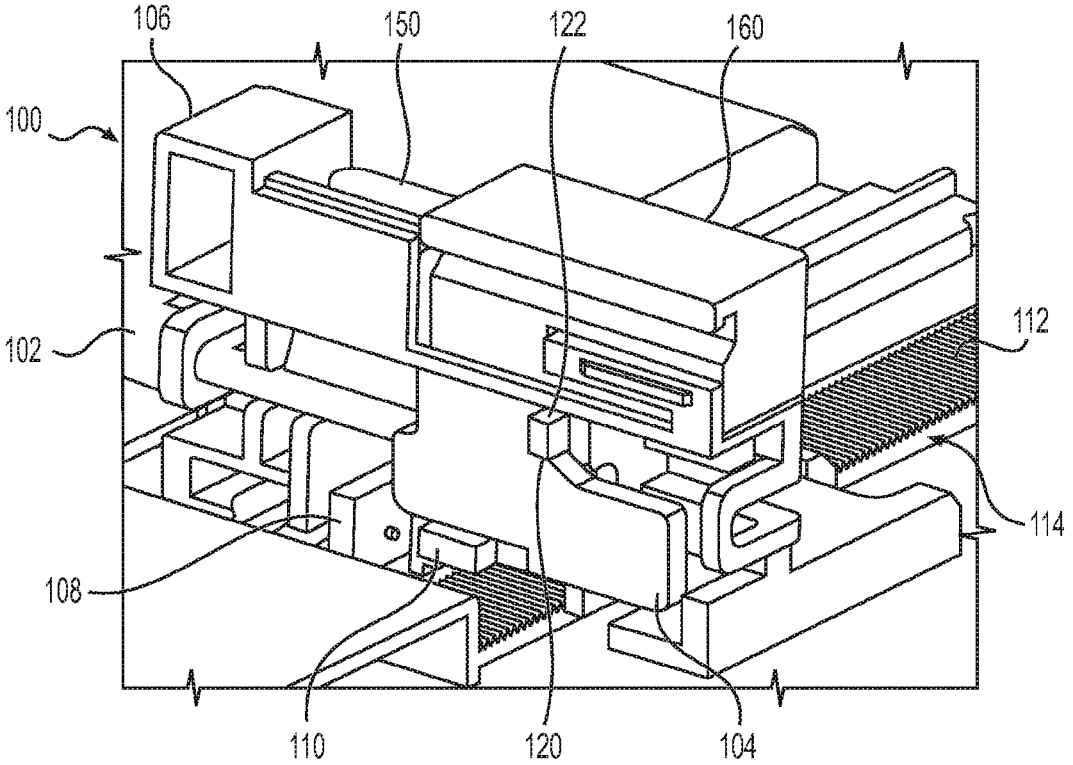
FIGS. 1A-1D, respectively, show perspective views of an example apparatus that may guide media in a media tray.

A media tray may include multiple standard pawl detents positioned at multiple predefined locations corresponding to variously sized media. The media tray may also include custom pawl teeth positioned along a rack. A guide may be moved to releasably engage selected ones of the standard pawl detents and/or the custom pawl teeth based on the size of the media housed or to be housed in the media tray. In instances in which the guide is not positioned to engage a correct one of the standard pawl detents or the custom pawl teeth for a particular sized media, the media may not be accurately bound in the media tray, which may lead to media jams or other media picking problems. These types of instances may occur, for instance, when a user moves the guide for a custom-sized media and then fails to move the guide back to a position for a standard-sized media or when a user does not know how to properly move the guide to the appropriate positions.

Disclosed herein are apparatuses, which may also be termed media guides or guides, and media trays that may include the apparatus. The apparatuses may include a guide frame, a standard position pawl movably attached to the guide frame, and a custom position pawl in movable engagement with the guide frame. The apparatuses may also include a switch that is in movable engagement with the guide frame. The switch may include a plurality of surfaces that may contact the standard position pawl and/or the custom position pawl depending upon the position of the switch. For instance, when the switch is in a first position, the custom position pawl may be maintained in a disengaged position with respect to the media tray. In addition, when the switch is in a second position, the custom position pawl may be free to move between the disengaged position and an engaged position with respect to the media tray. When the switch is in a third position, the switch may lock the custom position pawl into the engaged position and when the switch is in a fourth position, the switch may lock the standard position pawl into a standard pawl detent engaged position and may lock the custom position pawl in the engaged position. It should be understood that the references made herein to a first position, a second position, a third position, and a fourth position, are not meant to denote a particular order or sequence of positions. Instead, the terms "first," "second," "third," and "fourth" are used herein to differentiate the positions with respect to each other.

The switch may also include a cover that may move with the switch from a position that is adjacent to a release lever of the custom position pawl to a position that is over the release lever. As discussed in greater detail herein, the release lever may be moved between a first position and a second position to releasably engage and disengage, for instance, the custom position pawl with respect to the custom pawl teeth. In other examples, the release lever may be moved to releasably engage and disengage the standard position pawl. As also discussed herein, when the cover is positioned over the release lever, the release lever may not be accessible. In addition, when the cover is positioned over the release lever, a tab may maintain the switch in that position. As a result, the tab may be released in order to move the switch from that position to another position.

Through implementation of the apparatuses and media trays disclosed herein, the media trays may accommodate variously sized media in which the guides of the media may be maintained in various positions. In addition, the guides may include countermeasures to prevent the guides from being moved from their current positions.

Before continuing, it is noted that as used herein, the terms "includes" and "including" mean, but is not limited to, "includes" or "including" and "includes at least" or "including at least." The term "based on" means "based on" and "based at least in part on."

Reference is first made to FIGS. 1A-1D. FIGS. 1A-1D, respectively, show perspective views of an example apparatus 100 that may guide media in a media tray 102. Each of FIGS. 1A-1D show a switch 104 at a particular position with respect to a guide frame 106 of the apparatus 100. It should be understood that the example apparatus 100 depicted in FIGS. 1A-1D may include additional components and that some of the components described herein may be removed and/or modified without departing from the scope of the apparatus 100 disclosed herein. For instance, instead of the sliding switch disclosed herein, a rotary knob or other device may be used to selectively lock a standard position pawl and a custom position pawl in the apparatus 100. The apparatus 100 may also be referenced herein as a movable guide.

The media tray 102 may be a paper cassette for a printer, a copier, a facsimile machine, a multifunction machine, or the like. As discussed herein, the apparatus 100 may be in a sliding arrangement with the media tray 102 such that the apparatus 100 may be moved to particular distances with respect to, for instance, a wall of the media tray 102. The distance between the apparatus 100 and the wall of the media tray 102 may be varied to accommodate variously sized media. That is, the apparatus 100 may be a guide that may abut media in the media tray 102 to correctly align the media within the media tray 102 such that the media may be optimally picked from the media tray 102. For instance, the apparatus 100 may be movable to accommodate various standard sized media, such as letter size media, A4 size media, A3 size media, etc. The apparatus 100 may also be movable to accommodate media having custom sizes, e.g., sizes other than the standard sizes. The apparatus 100 may be movable with respect to the length of the media or the width of the media. Thus, for instance, the apparatus 100 may be movable in the length-wise direction or the apparatus 100 may be movable in the width-wise direction with respect to the media tray 102. In some examples, one apparatus 100 may be provided to be movable in the length-wise direction and another apparatus 100 may be provided to be movable in the width-wise direction of the media tray 102.

The apparatus 100 may include a guide frame 106, which may include sections to support various components of the apparatus 100 as well as to slidably engage the media tray 102. The various components may include the switch 104, a standard position pawl 108, and a custom position pawl 110. The standard position pawl 108 may be movably attached to the guide frame 106. For instance, the standard position pawl 108 may be cantilevered from the guide frame 106 such that an end of the standard position pawl 108 may be movable from a connection point of the standard position pawl 108 and the guide frame 106. As discussed herein, the standard position pawl 108 may engage standard pawl detents that may be spaced at predefined locations on the media tray 102. The predefined locations may correspond to standard media sizes.

The custom position pawl 110 may be movably engaged with the guide frame 106. Particularly, the custom position pawl 110 may be moved to releasably engage custom pawl teeth 112 of a rack 114 on the media tray 102. Through the selective engagement, e.g., contact, of the custom position pawl 110 with variously located custom pawl teeth 112 of the rack 114, the apparatus 100 may be moved and maintained at custom locations with respect to a wall of the media tray 102. In other words, the custom position pawl 110 may be positioned at various locations to enable the media tray 102 to accommodate custom media sizes.

As discussed herein, the switch 104 may be in movable engagement with the guide frame 106. For instance, the switch 104 may be in slidable engagement with the guide frame 106 such that the switch 104 may be movable between multiple positions with respect to the guide frame 106. As shown in FIG. 1A, the switch 104 may be in a first position with respect to the guide frame 106. While in the first position, the switch 104 may maintain the custom position pawl 110 at a disengaged position with respect to the custom pawl teeth 112. That is, the switch 104 may include a first surface 120 that may contact a first portion of the custom position pawl 110. The contact between the first surface 120 of the switch 104 and the first portion 122 of the custom position pawl 110 may cause the custom position pawl 110 to be moved away from the custom pawl teeth 112 such that the custom position pawl 110 is maintained in a disengaged position with respect to the custom pawl teeth 112. In the first position, therefore, the standard position pawl 108 may engage a standard pawl detent and the apparatus 100 may be locked into a position to accommodate standard sized media without being able to be locked into a position to accommodate custom sized media.

Figure 1B:
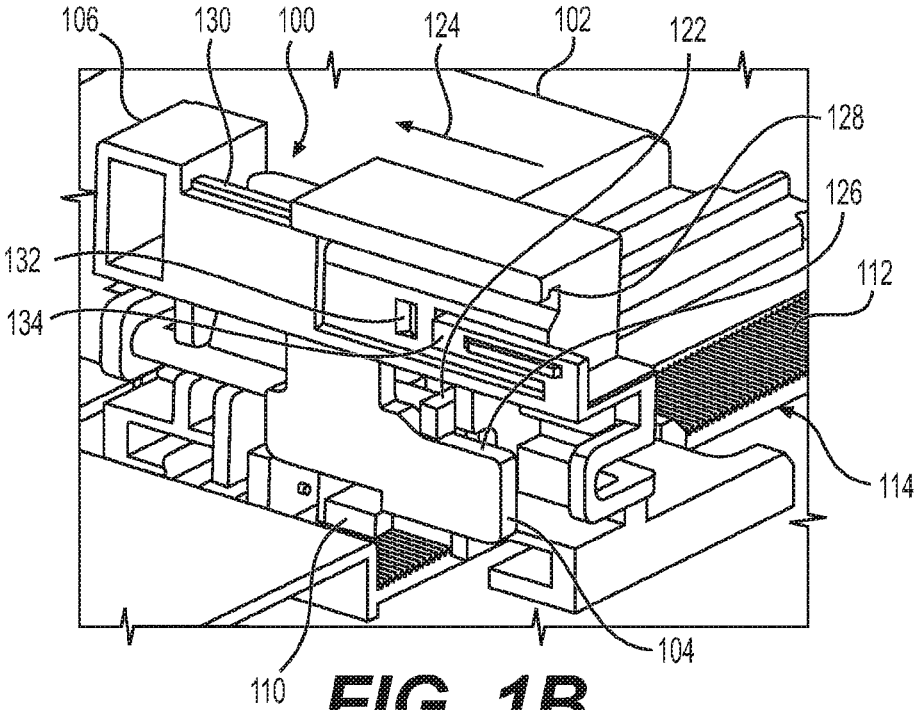
Figure 1C:
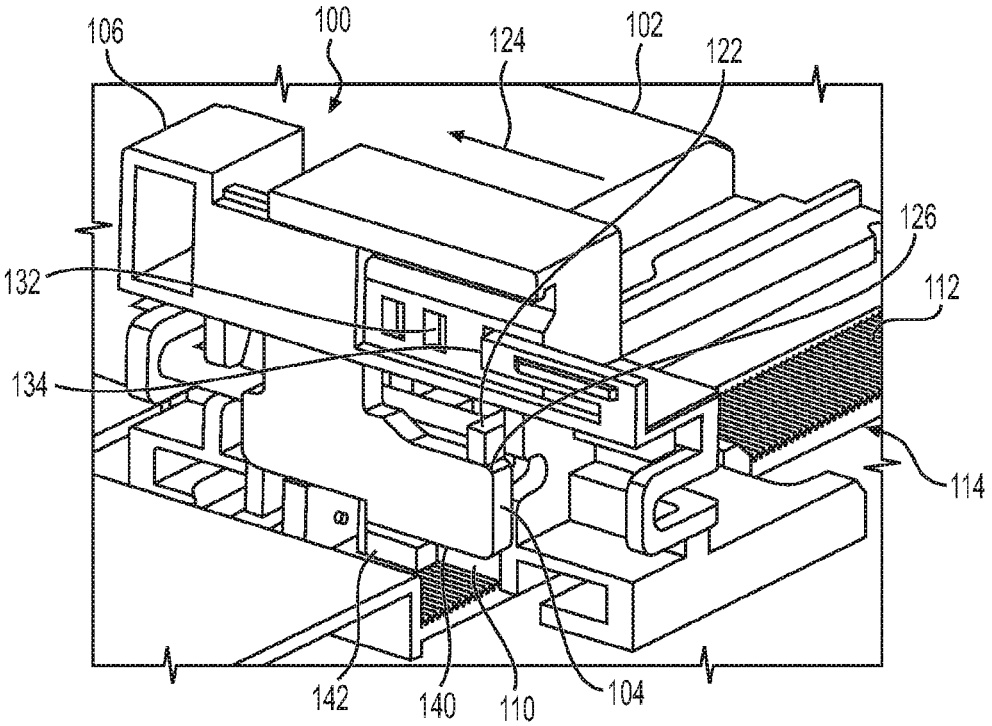

Turning now to FIG. 1B, the switch 104 may be moved in a direction as denoted by the arrow 124 with respect to the position of the switch 104 depicted in FIG. 1A. In FIG. 1B, the switch 104 may be in a second position at which the custom position pawl 110 may be free to move between the disengaged position and an engaged position with respect to the custom pawl teeth 112 of the rack 114 on the media tray 102. That is, when the switch 104 is in the second position as shown in FIG. 1B, the first portion 122 of the custom position pawl 110 may contact a second surface 126 of the switch 104. In other examples, the second surface 126 of the switch 104 may be sufficiently lower than the first surface 120 such that the first portion 122 of the custom position pawl 110 does not contact the second surface 126 when the switch 104 is in the second position. The second surface 126 may be relatively lower than the first surface 120 such that the custom position pawl 110 may be lowered to a position at which the custom pawl teeth at a bottom of the custom position pawl 110 may engage with the custom pawl teeth 112 of the rack 114. In addition, the switch 104 may include a space above the first portion 122 of the custom position pawl 110 to enable the custom position pawl 110 to be raised from the engaged position, e.g., to a raised position. In the second position, therefore, the switch 104 may have no constraining interactions with either the standard position pawl 108 or the custom position pawl 110. As such, for instance, while the apparatus 100 is in the second position, a release lever 150 (FIG. 2) may be moved such that an operator may choose either standard or custom sized media to be accommodated in the media tray 102.

It should be noted that a portion of the guide frame 106 has been removed from FIGS. 1A-1D such that a rear of the switch 104 may be visible. The guide frame 106 may thus include additional sections as shown in other figures herein. As shown in FIG. 1B, for instance, the switch 104 may include a channel 128 that may ride on a rail 130 on the guide frame 106 to move between the various positions as shown in FIGS. 1A-1D. The switch 104 may also include a plurality of switch detents 132 into which a flexible tab 134 of the guide frame 106 may be inserted. For instance, the flexible tab 134 may be inserted into a first switch detent 132 when the switch 104 is in the first position as shown in FIG. 1A, the flexible tab 134 may be inserted into a second switch detent 132 when the switch 104 is in the second position as shown in FIG. 1B, and so forth. The switch detents 132 may include angled walls such that the flexible tab 134 may be inserted into and removed from the switch detents 132 as the switch 104 is moved as denoted by the arrow 124. As a result, for instance, the insertion of the flexible tab 134 into the switch detents 132 may provide a tactile feedback such that user may determine that the switch 104 is in one of the multiple positions shown in FIGS. 1A-1C.

Turning now to FIG. 10, the switch 104 may be moved in a direction as denoted by the arrow 124 with respect to the position of the switch 104 depicted in FIG. 1B. In FIG. 10, the switch 104 may be in a third position at which the custom position pawl 110 may be locked into the engaged position. That is, the switch 104 may include a third surface 140 to which a second portion 142 of the custom position pawl 110 may contact when the switch 104 is in the third position. The contact between the second portion 142 of the custom position pawl 110 and the third surface 140 of the switch 104 may prevent the custom position pawl 110 from being raised from the engaged position. In this regard, while the switch 104 is in the third position, the apparatus 100 may be locked into a particular position in which custom-sized media may be held in the media tray 102.

Figure 1D:
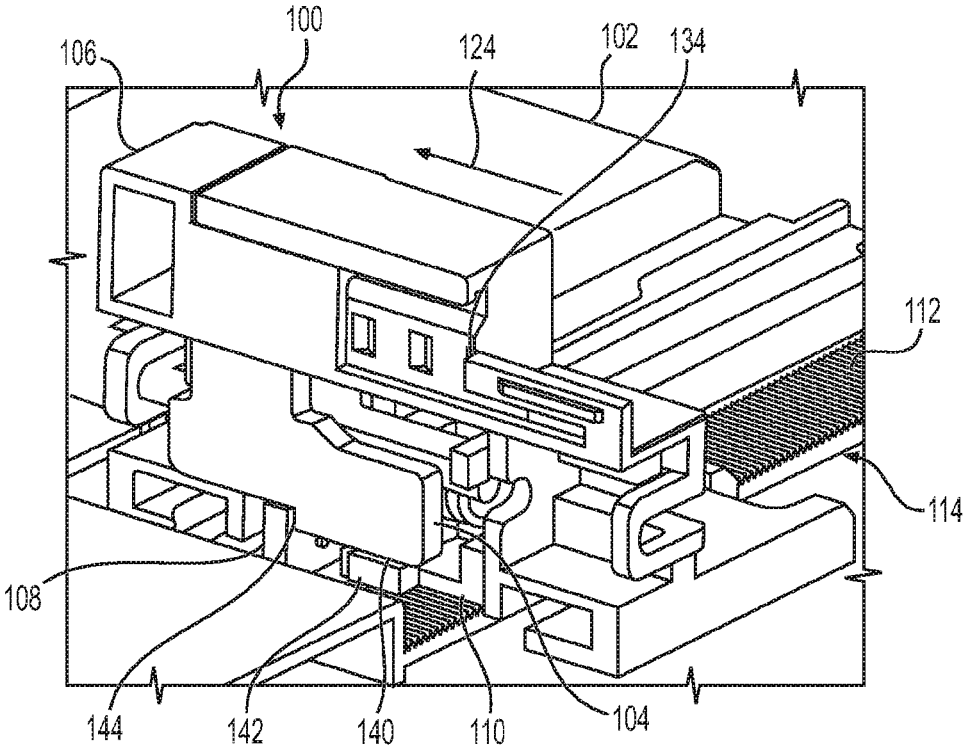

With reference now to FIG. 1D, the switch 104 may be moved in a direction as denoted by the arrow 124 with respect to the position of the switch 104 depicted in FIG. 10. In FIG. 1D, the switch 104 may be in a fourth position at which the custom position pawl 110 may be locked into the engaged position. In addition, while the switch 104 is in the fourth position, the standard position pawl 108 may contact a fourth surface 144 of the switch 104. The contact between the fourth surface 144 and the standard position pawl 108 may prevent the standard position pawl 108 from being moved into a direction that may cause the standard position pawl 108 from disengaging from a standard pawl detent in the media tray 102 as discussed in further detail herein. In this regard, while the switch 104 is in the fourth position, the apparatus 100 may be locked into a particular position in which a standard sized media may be accommodated in the media tray 102. In addition, while the apparatus is in the fourth position, the third surface 140 of the switch 104 may contact the second portion 142 of the custom position pawl 110 to prevent the custom position pawl 110 from disengaging the custom pawl teeth 112. In one regard, having both the standard position pawl 108 and the custom position pawl 110 in their locked positions may help ensure that the apparatus 100 remains in a particular position with respect to the media tray 102.

Figure 2:
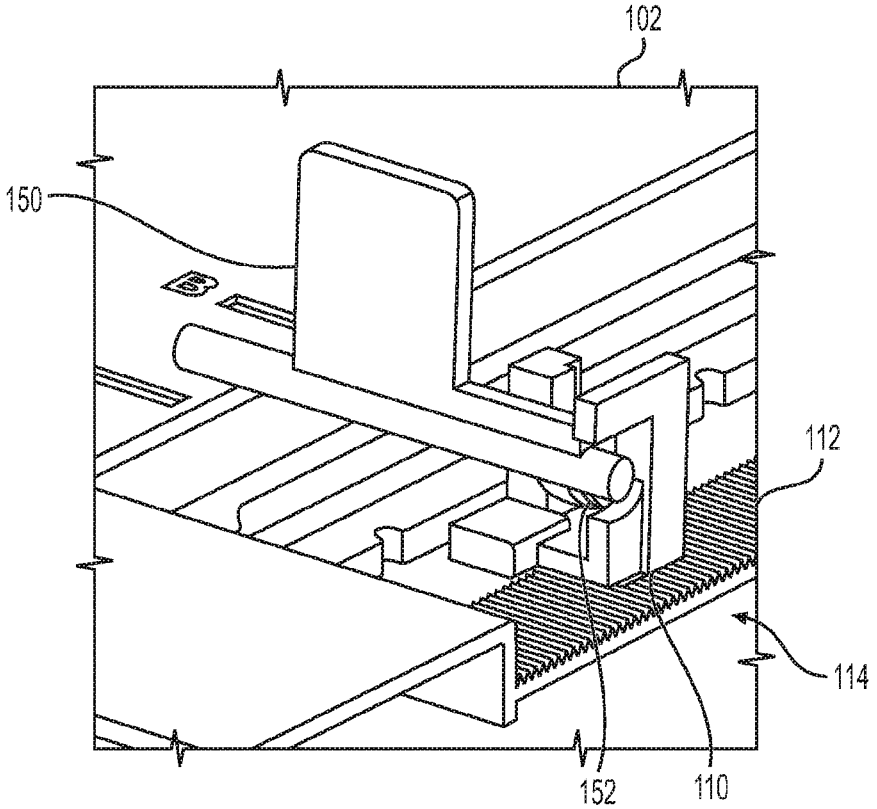
FIG. 2 shows a perspective view of an example release lever and the custom position pawl depicted in FIGS. 1A-1D.

Reference is now made to FIG. 1A and FIG. 2. FIG. 2 shows a perspective view of an example release lever 150 and the custom position pawl 110 shown in FIGS. 1A-1D. The release lever 150 may be rotatably supported in the guide frame 106 such that the release lever 150 may rotate between a first lever position and a second lever position. While in the first lever position as shown in FIG. 2, the release lever 150 may be disengaged from the custom position pawl 110. As a result, the custom position pawl 110 may be engaged with the custom pawl teeth 112 of the rack 114. However, when the release lever 150 is depressed and thus moved to a second lever position, a lever portion 152 may engage the custom position pawl 110 and may cause the custom position pawl 110 to be disengaged from the custom pawl teeth 112. Thus, for instance, the custom position pawl 110 may be biased toward engagement with the custom pawl teeth 112 and the release lever 150 may move the custom position pawl 110 away from the custom pawl teeth 112 such that custom pawl teeth on the bottom of the custom position pawl 110 may be disengaged from the custom pawl teeth 112 of the rack 114. Although not shown, the release lever 150 may additionally or alternatively, selectively engage the standard position pawl 108.

As also shown in the FIGS. 1A-1D, the switch 104 may include a cover 160. When the switch 104 is in the first position as shown in FIG. 1A, e.g., to a side of the release lever 150, the release lever 150 may be accessible. However, when the switch 104 is in the fourth position as shown in FIG. 1D, the cover 160 may be positioned over the release lever 150 to block access to the release lever 150. In addition, when the switch 104 is in the fourth position, a side wall of the flexible tab 134 may abut the switch 104 to prevent the switch 104 from being moved from the fourth position. The flexible tab 134 may include a relatively flat surface such that the switch 104 may be prevented from being moved in the direction opposite the direction denoted by the arrow 124 when pressure is applied onto the switch 104 in that direction. Instead, to move the switch 104 in that direction, the tab 134 may be depressed such that the tab 134 may clear the switch 104, which may enable the switch 104 to be moved from the fourth position to the third position. As a result, when the switch 104 is in the fourth position, a user may not access the release lever 150 without first intentionally moving the switch 104 from the fourth position.

Figure 3:
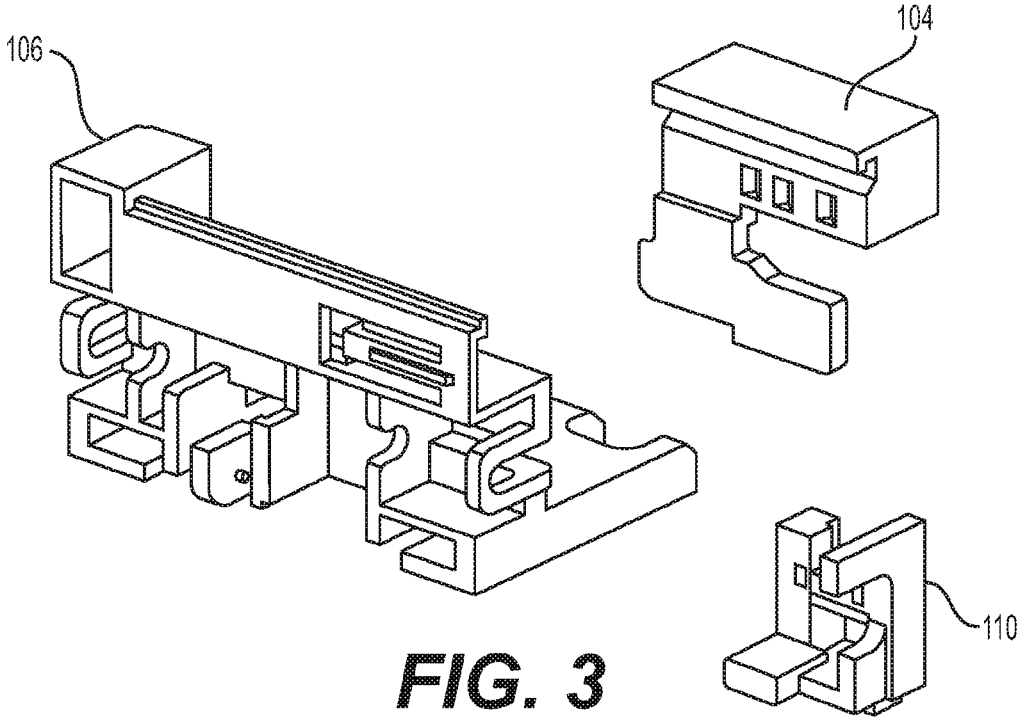
FIG. 3 shows perspective views of some of the components of the example apparatus depicted in FIGS. 1A-1D.

Turning now to FIG. 3, there are shown perspective views of some of the components of the example apparatus 100 depicted in FIGS. 1A-1D. Particularly, FIG. 3 shows a perspective view of the switch 104, the guide frame 106, and the custom position pawl 110 in a disassembled state.

Figure 4A:
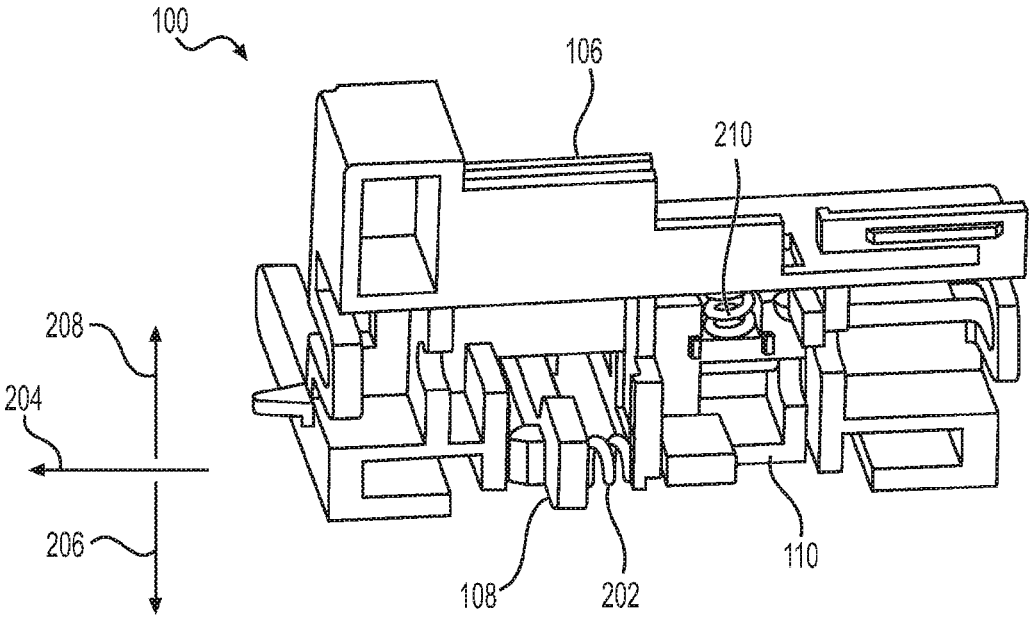
FIG. 4A shows a rear perspective view and FIG. 4B shows a bottom perspective view of the example apparatus depicted in FIGS. 1A-1D.
Figure 4B:
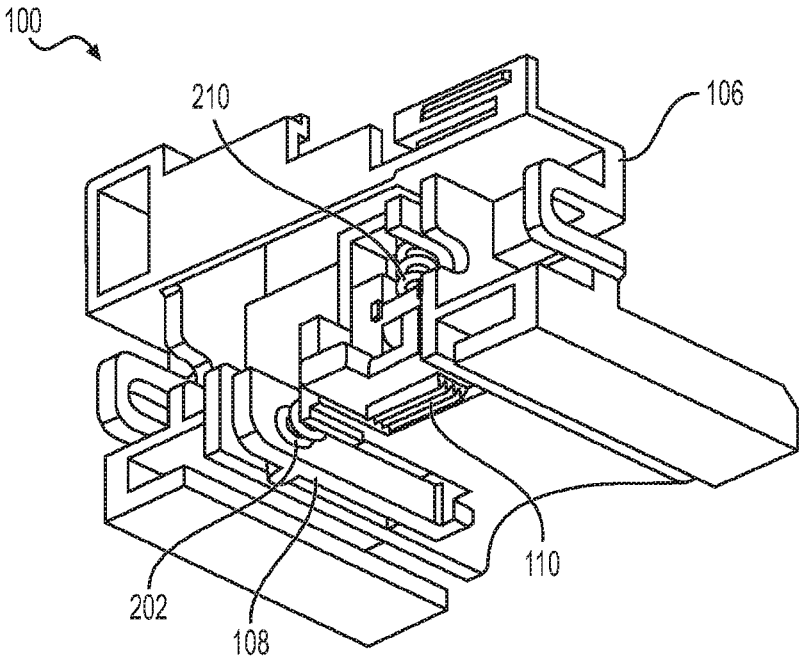
Figure 5A:
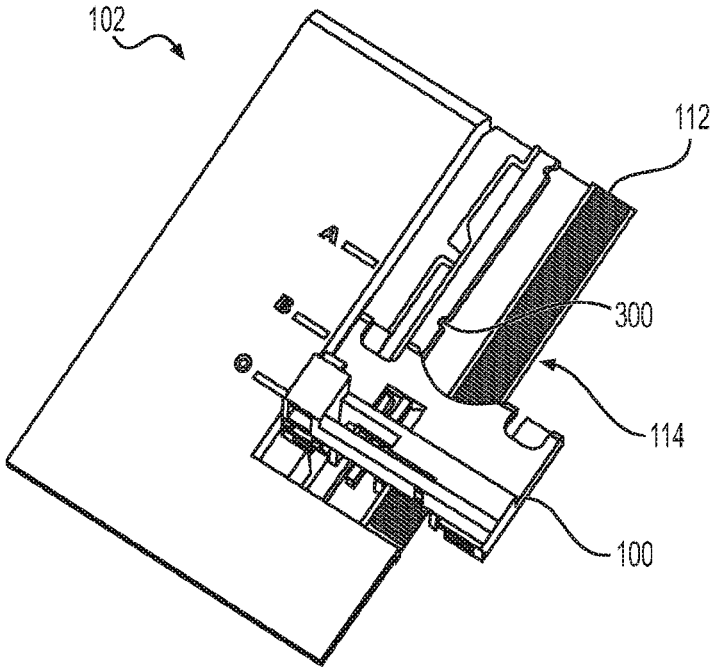
FIG. 5A shows a top perspective view of the example apparatus and a portion of a media tray to which the example apparatus depicted in FIGS. 1A-1D may be movably supported.
Figure 5B:
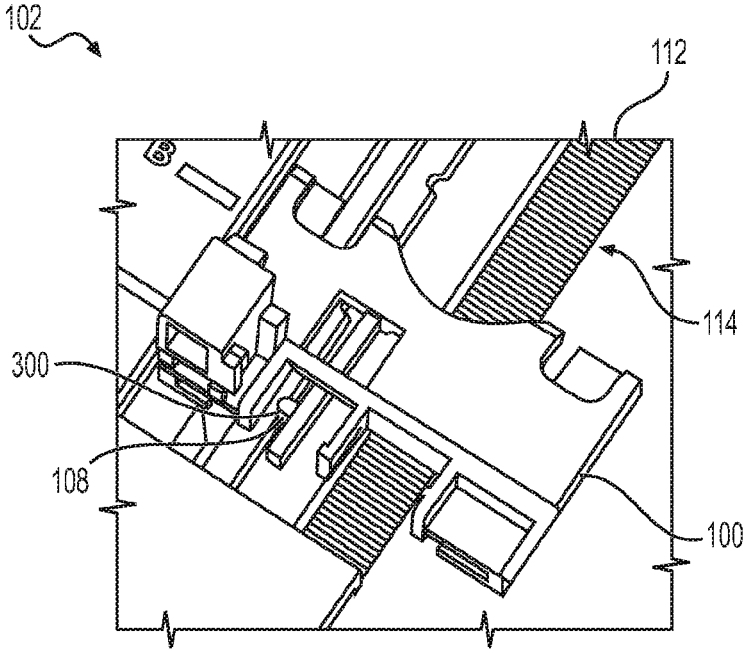
FIG. 5B shows an enlarged view of the example apparatus and the portion of the media tray with a portion of the example apparatus depicted in FIG. 5A removed.

Reference is now made to FIGS. 4A, 4B, 5A, and 5B. FIG. 4A shows a rear perspective view of the example apparatus 100 and FIG. 4B shows a bottom perspective view of the example apparatus 100 depicted in FIGS. 1A-1D. FIG. 5A shows a top perspective view of the example apparatus 100 and a portion of a media tray 102 to which the example apparatus 100 may be movably supported. FIG. 5B shows an enlarged view of the example apparatus 100 and the portion of the media tray 102 with a portion of the example apparatus 100 depicted in FIG. 5A removed. It should be understood that the apparatus 100 depicted in FIGS. 4A, 4B, 5A, and 5B and/or the media tray 102 depicted in FIGS. 5A and 5B may include additional components and that some of the components described herein may be removed and/or modified without departing from the scopes of the apparatus 100 and/or the media tray 102 disclosed herein.

As shown in FIGS. 4A and 4B, a spring 202 may bias the standard position pawl 108 in a first direction as denoted by the arrow 204. The standard position pawl 108 may be integrally formed with the guide frame 106 or may be separate from the guide frame 106 and may be attached to the guide frame 106 through friction fitting, an adhesive, a mechanical fastener, or the like. In some examples, the standard position pawl 108 may in slidable engagement with the apparatus 100. In addition, or alternatively, the standard position pawl 108 may be oriented in a similar manner to the custom position pawl 110 or in another orientation. In these examples, the standard pawl detents, the custom pawl teeth 112, the standard position pawl 108, and/or the custom position pawl 110 may be in any of various other orientations.

The custom position pawl 110 may be movably engaged with the guide frame 106 such that the custom position pawl 110 may be movable in the directions denoted by the arrows 206 and 208. A spring 210 may bias the custom position pawl 110 in a downward direction as denoted by the arrow 206. That is, the custom position pawl 110 may include custom pawl teeth to engage with the custom pawl teeth 112 of the rack 114 and the spring 210 may bias the custom pawl teeth of the custom position pawl 110 to engage with the custom pawl teeth 112 of the rack 114. As discussed herein, movement of the release lever 150 may cause the custom position pawl 110 to be moved in the direction denoted by the arrow 208.

As shown in FIGS. 5A and 5B, the media tray 102 may include a plurality of standard pawl detents 300. As the apparatus 100 is moved with respect to the media tray 102, the standard position pawl 108 may selectively engage the standard pawl detents 300. The standard position pawl 108 may include a rounded shape or profile, which may be similar to the shape of the standard pawl detents 300, or may include another shape or profile. In this regard, as the apparatus 100 is moved with respect to the media tray 102, the standard position pawl 108 may engage a standard pawl detent 300 (which may also be referenced herein as a switch standard pawl detent 300) and may also subsequently be disengaged from the standard pawl detent 300. In addition, the spring 202 may bias the standard position pawl 108 to remain engaged with the standard pawl detent 300 and may thus improve a tactile feedback for a standard sized position of the apparatus 100 while the standard position pawl 108 is engaged with the standard pawl detent 300. The spring 202 may also provide a positional holding force on the standard position pawl 108. However, when sufficient force is applied to move the apparatus 100, the standard position pawl 108 may disengage from the standard pawl detent 300 and the apparatus 100 may be moved, e.g., slid, with respect to the media tray 102. In addition, when the apparatus 100 is moved a sufficient distance, the standard position pawl 108 may engage a different standard pawl detent 300 on the media tray 102. As a result, the apparatus 100 may be moved and maintained at particular positions with respect to a wall of the media tray 102 such that different sized media may be accommodated in the media tray 102.

As discussed herein, when the switch 104 is moved to the fourth position, the switch 104 may contact the standard position pawl 108 to lock the standard position pawl 108 into a standard pawl detent engaged position. In addition, while the switch 104 is in the fourth position, the switch 104 may contact the second portion 142 of the custom position pawl 110 to prevent the custom position pawl 110 from being moved in the direction denoted by the arrow 208. As a result, application of pressure onto the apparatus 100 may not cause the standard position pawl 108 to become disengaged from the standard pawl detent 300 into which the standard position pawl 108 has been inserted and thus, the apparatus 100 may be maintained at a current position. The switch 104 may thus be moved to the fourth position, for instance, to prevent the apparatus 100 from unintentionally being moved from a set position.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. An apparatus comprising:
- a guide frame;
- a standard position pawl movably attached to the guide frame, the standard position pawl to engage a standard pawl detent on a media tray;
- a custom position pawl movably engaged with the guide frame, the custom position pawl to engage custom pawl teeth of a rack on the media tray; and
- a switch in movable engagement with the guide frame, the switch being movable between:
  - a first position at which the custom position pawl is maintained at a disengaged position with respect to the custom pawl teeth;
  - a second position at which the custom position pawl is free to move between the disengaged position and an engaged position with respect to the custom pawl teeth; and
  - a third position at which the custom position pawl is locked into the engaged position.

2. The apparatus of claim 1, wherein the switch is movable to a fourth position at which the standard position pawl is locked into a standard pawl detent engaged position and the custom position pawl is locked into the engaged position.

3. The apparatus of claim 2, further comprising:
- a release lever rotatably supported in the guide frame, the release lever being movable between a first lever position at which the custom position pawl is movable with respect to the rack and a second lever position at which the custom position pawl is disengaged from the rack.

4. The apparatus of claim 3, wherein the switch includes a cover, wherein the cover is to be positioned to a side of the release lever when the switch is in the first position and the second position and wherein the cover is to be positioned over the release lever when the switch is in the fourth position.

5. The apparatus of claim 2, wherein the switch includes a plurality of switch standard pawl detents positioned at multiple positions and the guide frame includes a flexible tab to be selectively inserted into one of the plurality of switch standard pawl detents when the switch is in one of the first, second, and third positions.

6. The apparatus of claim 5, wherein the flexible tab includes a side wall that is to abut the switch when the switch is in the fourth position to prevent the switch from being moved from the fourth position.

7. The apparatus of claim 1, wherein the standard position pawl is movable along a first direction and the custom position pawl is movable along a second direction, the second direction being perpendicular to the first direction.

8. A media tray comprising:
- a set of standard pawl detents positioned at predefined locations along a first direction;
- a rack having custom pawl teeth;
- a movable guide having:
  - a guide frame;
  - a standard position pawl movably attached to the guide frame, the standard position pawl to selectively engage the set of standard pawl detents;
  - a custom position pawl movably engaged with the guide frame, the custom position pawl to engage the custom pawl teeth of the rack; and
  - a switch in movable engagement with the guide frame, the switch being movable between:
    - a first position at which the custom position pawl is maintained at a disengaged position with respect to the custom pawl teeth of the rack;
    - a second position at which the custom position pawl is free to move between the disengaged position and an engaged position with respect to the custom pawl teeth of the rack; and
    - a third position at which the custom pawl is locked into the engaged position.

9. The media tray of claim 8, wherein the switch is further movable between a fourth position at which the standard position pawl is locked into a standard pawl detent engaged position and the custom position pawl is locked into the engaged position.

10. The media tray of claim 9, wherein the movable guide further comprises:
- a release lever rotatably supported on the guide frame, the release lever being movable between a first lever position at which the custom position pawl is movable with respect to the rack and a second lever position at which the custom position pawl is disengaged from the rack.

11. The media tray of claim 10, wherein the switch includes a cover, wherein the cover is to be positioned to a side of the release lever when the switch is in the first position and the second position and wherein the cover is to be positioned over the release lever when the switch is in the fourth position.

12. The media tray of claim 11, wherein the switch includes a plurality of switch standard pawl detents positioned at multiple positions and the guide frame includes a flexible tab to be selectively inserted into one of the plurality of switch standard pawl detents when the switch is in one of the first, second, and third positions, and wherein the flexible tab includes a side wall that is to abut the switch when the switch is in the fourth position to prevent the switch from being moved from the fourth position.

13. A system comprising:

a guide frame;

a standard position pawl movably attached to the guide frame, the standard position pawl being biased toward a first direction;

a custom position pawl movably engaged with the guide frame, the custom position pawl being biased toward a second direction that differs from the first direction;

a release lever rotatably supported in the guide frame, the release lever being movable between a first lever position at which the custom position pawl is movable between the second direction and a third direction and a second lever position at which the custom position pawl is moved in the third direction; and a switch in movable engagement with the guide frame and in selective contact with the standard position pawl and the custom position pawl, the switch being movable between a first position at which the switch maintains the custom position pawl at a raised position, a second position at which the custom position pawl is free to move in the second direction and the third direction, a third position at which the switch maintains the custom position pawl at a lowered position, and a fourth position at which the switch contacts the standard position pawl and prevents the standard position pawl from moving in a fourth direction that is opposite the first direction.

14. The system of claim 13, wherein the switch includes a cover, wherein the cover is positioned to a side of the release lever when the switch is in the first position and the second position and wherein the cover is positioned over the release lever when the switch is in the fourth position.

* * * * *